United States Patent [19]

Weinrib

[11] Patent Number: 4,776,753

[45] **Date of Patent: * Oct. 11, 1988**

[54] METHOD OF AND APPARATUS FOR PUMPING VISCOUS FLUIDS

[75] Inventor: Harry P. Weinrib, Chicago, Ill.

[73] Assignee: Eddy Pump Corporation, Chicago, Ill.

[ * ] Notice: The portion of the term of this patent subsequent to Jun. 24, 2003 has been disclaimed.

[21] Appl. No.: 923,915

[22] Filed: Oct. 28, 1986

[51] Int. Cl.[4] ..... F01D 1/08

[52] U.S. Cl. ..... 415/53 R; 415/88; 415/120; 415/213 A

[58] Field of Search ..... 415/83, 88, 53 R, 213 A, 415/120, 1, 89, 52, 213 R, 213 C

[56] References Cited

U.S. PATENT DOCUMENTS

| | | | |
|---|---|---|---|
| 1,945,759 | 11/1933 | Sim | 417/67 |
| 2,148,131 | 9/1936 | Parker | 417/54 |
| 2,480,969 | 10/1946 | Da Silva Rosa | 417/76 |
| 2,690,130 | 11/1949 | Boeckeler | 417/83 |
| 3,072,057 | 2/1960 | Da Silva Rosa | 417/90 |
| 3,093,080 | 3/1963 | Tarifa et al. | 415/24 |
| 3,151,560 | 2/1964 | Erickson | 417/69 |
| 3,304,066 | 7/1964 | Conhagen | 261/29 |
| 3,477,383 | 3/1968 | Rawson et al. | 415/88 |
| 3,519,365 | 9/1968 | Vieceli et al. | 415/88 |
| 3,776,658 | 12/1973 | Da Silva Rosa | 415/88 |
| 3,791,757 | 2/1974 | Tarifa et al. | 415/89 |
| 3,809,491 | 5/1974 | Banyai | 415/88 |
| 3,817,659 | 6/1974 | Erickson et al. | 417/84 |
| 4,161,448 | 7/1979 | Erickson et al. | 210/258 |
| 4,278,397 | 7/1981 | Bachl | 415/83 |
| 4,596,511 | 6/1986 | Weinrib | 415/53 R |

FOREIGN PATENT DOCUMENTS

| | | | |
|---|---|---|---|
| 971042 | 11/1958 | Fed. Rep. of Germany | 415/53 R |
| 42116 | 4/1959 | Poland | 415/53 R |
| 937785 | 10/1980 | U.S.S.R. | 415/53 R |
| 840486 | 6/1981 | U.S.S.R. | 415/53 R |

*Primary Examiner*—Robert E. Garrett
*Assistant Examiner*—Joseph M. Pitko
*Attorney, Agent, or Firm*—Fitch, Even, Tabin & Flannery

[57] ABSTRACT

A method and apparatus for pumping liquid includes a pump casing with a vortex generating member which generates a swirling column of liquid which swirls about a central axis and which is directed through the pump inlet to discharge into the ambient body of liquid at which its energy is quickly dissipated. The surrounding ambient liquid is drawn through the pump inlet in a counterflow to the vortex column flow and flows into the pump casing and then out through a pump discharge. The preferred vortex generating member was channels of decreasing size converging toward the axis of the vortex column with the streams of liquid increasing their respective velocities as they flow toward the axis at which the streams join and concentrate their energies to form the vortex column. Preferably, the vortex member is driven by a power source.

9 Claims, 3 Drawing Sheets

METHOD OF AND APPARATUS FOR PUMPING VISCOUS FLUIDS

This invention relates to a method of and apparatus for pumping viscous fluids which are often thick, paste-like, or paint-like fluids and which also may be borderline plastics or thixotropic materials.

BACKGROUND OF THE INVENTION

The present invention is directed to pumping very viscous fluids which are difficult or impossible to pump with ordinary centrifugal pumps at efficiencies to be commercially practical. Such viscous fluids are non-Newtonian, in that, under laminar conditions, the viscosity is not a constant. The present invention will be described hereinafter in connection with one usage successfully pumped and that usage is digested sludge at about 14.3% by weight of organic solids; but, the invention is capable of use in pumping other viscous fluids, such as paints, plastics, foods such as tomato catsup, tomato paste, etc . . . Many of these fluids behave as a Bingham plastic or a borderline Bingham plastic in which the head requirements for elevation change and for velocity may be the same as for water, but the friction losses are substantially higher than for water. Unlike water flow which is usually turbulent when being pumped through pipelines, these viscous materials such as digested sludge of 10%, plus solids may experience laminar flow with friction losses many times greater than friction losses for water. Indeed, charts are available to determine a multiplication factor for digested sludge or untreated or primary and concentrated sludges where laminar sludge flow occurs and one wants to determine the friction losses for pumping sludge relative to friction losses for pumping water.

Sludge and other materials are sometime called "psuedoplastic" or borderline plastic materials, or, in some instances, Bingham plastic materials in which essentially no flow occurs unless the pressure is high enough to exceed a yield stress constant. In addition to the yield stress constant, another constant, which is the coefficient of rigidity, is also determined. With these constants determined, the pressure drop over a range of velocities may be found after calculating the Reynolds number and the Hedstrom number. A much higher velocity is needed for turbulent flow to occur for these viscous materials such as sludge; but, once turbulent flow is achieved, the pressure drop may be roughly thtt of water.

Sludge having a solids content of 10% or greater is a thixotropic material having a flow resistance depending on the length of time shearing and the intensity of shearing with the viscosity dropping at the time of shearing followed by a gradual recovery of viscosity when the shearing is stopped. Attempts have been made heretofore to assist centrifugal pumps in pumping sludge by agitating the sludge with motor driven impellers adjacent the pump inlet. While experimental pumping has been achieved of sludge of solids of 10% and greater using such auxiliary impellers with centrifugal pumps, the results have not been satisfactory to warrant commercial adoption thereof.

Sludge is accumulated in large quantities at waste water treatment plants and is often put into ponds or lagoons for long periods for storage and thickening prior to the sludge being transported to a disposal site or being utilized as a soil conditioner or fertilizer. The digested sludge increases in viscosity very quickly with being dehydrated. Sludge of about six percent solids by weight of organic material may be almost water-like in appearance and have a viscosity more akin to water in that it may be pumped successfully by commercial impeller driven pumps or other types of pumps. However, when the solids content is increased to ten percent, it is questionable as to whether or not impeller pumps can pump the sludge because of the viscosity of the material and its friction losses. When the solids content by weight is approximately ten percent, if there is any pumping at all using conventional pumps, it is accomplished only by the use of large quantities of power under very strenuous and demanding operating conditions. Little pumping is done of digested sludge having a ten percent solid, organic component. Digested sludge generally has large amounts of microorganisms which have digested the sludge and secreted material, many of which are like polysaccharides which are like a glue material which tends to stick and stick not only to pump parts but also to other organic organism materials.

Digested sludge of 10–20% solids is a generally thixotropic material and acts more like a semi-solid or a gelatin-like material than like water. Many of the microorganisms secrete carbon dioxide or other gases so there is a high concentration of dissolved gases in activated sludge. Further, the digestive bacteria in the sludge hydrate, i.e. swell with water and there is a considerable amount of bound water such that the sludge may be viscous although the density of the sludge fairly nearly approaches that of water rather than a higher density viscous material. Conventional impeller pumps quickly cavitate and fail to pump activated sludges having an organic solids content of eight percent or more organic. The cavitation is accompanied by the formation of gas or bubbles of gas which implode against the impeller causing the metal of the impeller to erode quickly while requiring higher amounts of power to drive the pump. Cavitation progresses until there is generally only bubbles and gases emanating from the pump. It appears that the viscous nature of tne digested sludge prevents the net positive suction head required to be met such that the pump is not receiving the sludge material required before it goes into cavitation. In some instances, a centrifugal pump when first lowered into a concentrated lagoon of sludge will pump sludge initially and then fail to pump and cavitate because the sludge will not flow into the pump inlet in sufficient quantities.

In other instances, vortex pumps have been used for pumping sludge. Such vortex pumps have a saucer shaped disk which have vanes on the inner curved surface of the disk. However, such vortex pumps are very inefficient and do not appear to pump sludge of ten percent or more solids.

Another problem with existing pump technology is that there may be a requirement for the use of water at the packing or bearings about the impeller shaft seal seal to flush the bearing and seals to prevent an ingress of sludge and inorganic material within the sludge from moving into the bearing and seal and destroying the packing and/or bearing. The use of water at such a seal is counter productive in that there may be as much as 15 to 20 gallons per minute used at the seal with the water leaking into the sludge, which is working in the opposite direction to all of the time and effort that has been expended to extract water from the sludge to make it a more solid for use as a fill. Within digester tanks, a vacuum or low pressure is created within the tank to draw off water vapor to concentrate the sludge. In some settling ponds, the sludge is graded by being pulled up a steep slope by a bucket or other mechanical device to allow water within the sludge to drain down the slope for collection and removal from the sludge. The water-like material withdrawn from the sludge is called "supernatant".

In large tanks of sludge, it is often the common practice where the solids content is very high, for example, 15% to 16% solids of organic material, to use power-operated buckets to scoop buckets of sludge for depositing into a truck for removal. At the 15% or 16% solids, the sludge appears to be solid whereas it is, in fact, a semi-solid or borderline plastic which has some attributes of liquid and some attributes of solids. When the organic solid materials reaches 20%, the dewatered activated sludge almost appears dry and will wobble and quake like a bowl of jelly. Even at this high percentage of solids, specific gravity of the sludge is not that much greater than water alone. Thus, sludge of a high solids content is a highly viscous and a very tacky adhesive-like material which has been found to be difficult to pump. There is a need to pump such sludge as well as other very viscous materials and also there is a need to improve existing pumping techniques for viscous materials.

Accordingly, a general object of the present invention is to provide a new and improved method and apparatus for pumping viscous materials.

Another object of the invention is to provide a new and improved method for pumping thixotropic materials.

A still further object of the invention is a new and improved method of and an apparatus for pumping sludge.

A more specific object of the invention is to provide a method and apparatus for pumping digested sludge having 10% solids or greater by weight of organic materials.

Other objects and advantages of the invention will become apparent from the following detailed description taken in conjunction with the accompanying drawings in which:

Figure 2:
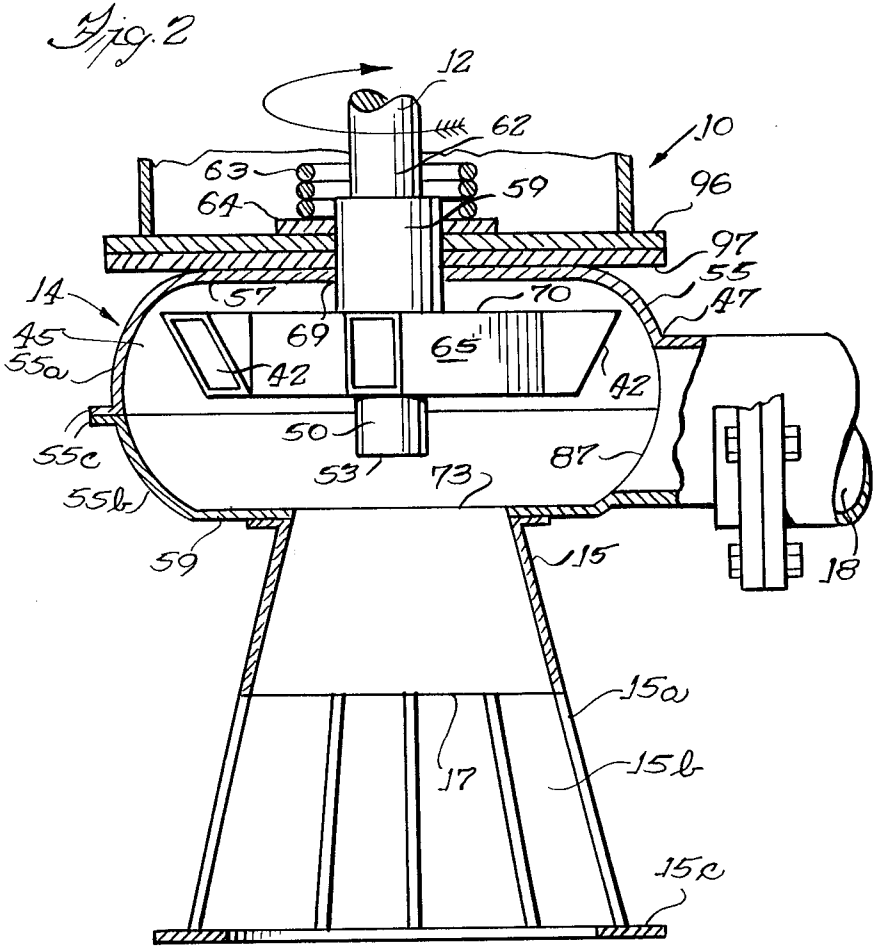
FIG. 2 is a cross-sectional view showing the inside of the pumping apparatus of FIG. 1.

As shown in the drawings for purposes of illustration, the invention is embodied in a pump 10 having motor 11 (FIG. 1) which drives a shaft 12 extending to a pump housing or casing 14. The illustrated pump has a pump inlet means in the form of an inlet conduit 15 which extends into a pool of activated sludge 16 for lifting the sludge into the casing 14 from which the sludge is discharged through one or more pump discharge outlets 18. The present invention will be described hereinafter in connection with a vertical orientation of the pump 10 (FIG. 1), but it is to be understood that the pump is capable of being orientated in various manners and that the vertical directions given herein are by way of illustration only and are not intended to limit the invention to any particular orientation of the pump.

The present invention is particularly directed to the pumping of viscous materials of various kinds. The term "sludge" is used hereinafter only to describe the illustrated embodiment of the invention and other viscous materials may also be pumped with this invention. The sludge is usually digested, dewatered sludge which has a relatively high solids content of organic material and a small amount of inorganic material. The sludge is usually located within a sewage treatment facility, e.g. within a digester or in a pond, lagoon or storage tank from which it is desired to be moved. For the less viscous sludges having a solids content of 6% by weight, or less, of organic material, the viscosity is such that commercial centrifugal impeller pumps may be used to pump the sludge from one location to another. Some sludge has a fibrous and filamentary content including strands of human hair that tends to bind and clog impellers after prolonged usage, even when the sludge is only 6%, or less, in solids content. While the sludge is often initially treated to remove sand and other inorganic material, some of this material remains and may wear bearings and shaft seals for the sludge pump. In operations where the seals and bearings wear quickly, resort is sometimes had to the use of water as a liquid seal or to flush and protect the packing and/or bearings. However, such liquid seals are counter-productive in adding water e.g. 20 gallons per minute back into the sludge.

It is thought one reason why centrifugal pumps can not satisfactorily pump sludge having a solids content of 10% or more is that the net positive suction head required is not met because this thick viscous, sticky sludge doesn't flow through the pump inlet at the required flow rate to prevent cavitation. Because the digested sludge has so many microorganisms therein, many of which generate a gas which becomes dissolved or trapped within the sludge, the impeller blade is quick to generate bubbles of gas which implode during cavitation and quickly erode the impeller and pump surfaces. Sludge, of greater than 10% by weight, is a thixotropic material and the present invention is particularly useful for pumping thixotropic fluids although the invention is not limited to thixotropic materials because non-thixotropic viscous fluids may also be pumped with this invention.

In accordance with the present invention, viscous fluids such as, for example, sludge of greater than 10% by weight of organic material can be pumped by directing a pressurized traveling column stream 30 (FIG. 3) viscous fluid from a runner or impeller 35 through a pump inlet 15 into a surrounding pool 16 of viscous fluid. The high pressure outwardly traveling stream 30 impacts into the pool of viscous sludge, and expands in a generally cone-shaped configuration and in so doing imparts energy and movement to the viscous fluid about the pump inlet 15 causing the viscous fluid to become agitated and turbulent. For thixotropic fluids this agitation and turbulence reduces the viscosity of the fluid making it more flowable into the inlet 15 of the pump about the stream 30. It is thought that an inwardly flowing annular column of fluid is generated and swirls in an opposite, counter direction of rotation to the direction of rotation of the vortex stream 30 liquid swirl. In any event, the upwardly annular stream of fluid moves into a pump chamber 47 foom which the fluid exits at a discharge opening 87 and through the pump outlet 18. In this instance, the pump is illustrated as having one outlet 18, although more than one outlet may be used. In pumping a viscous fluid such as sludge having a solids content of 14.3% by weight of organic solids (as described hereinafter), there appears to be a circular area or cone of about 15 feet to 20 feet, herein termed an influence circle or cone, in which the discharging vortex stream is shearing the sludge and dropping the viscosity of the sludge. Air bubbles and agitation delineate this cone of influence from the quiescent sludge in the pool. The sludge pool also forms a hollow cone 37 about the pump and actually forms a funnel-like depression as the viscous sludge flows down to replenish the sludge being pumped. This is unlike water or other Newtonian fluids which quickly flow and maintain a substantially flat upper surface. The conical depression 37 also appears to have lines therein indicating a more laminar shift of fluid toward the pump inlet pool of reduced viscosity. This sludge appears to be like chocolate pudding in its appearance and its flowability (without energy imparted thereto), rather than like water.

Herein, the vortex member runner 35 concentrates the energy being imparted to the fluid which forms the relatively slender, outwardly traveling stream 30 of fluid having a high angular velocity at a high outward velocity component which upon reaching end 17 of the inlet 15 dissipates its momentum into the ambient viscous fluid pool 16 which swirls and agitates as shown in FIG. 2, to cause the viscosity of the thixotropic sludge to be reduced. The reduced viscosity sludge then flows more readily inwardly about the vortex stream 30 in an upward direction and forms a separate annular stream 31 about the vortex stream as shown by the directional arrows 40 whereas the directional arrow 36 shows that the vortex stream liquid 30 flowing downwardly. As illustrated, the inner vortex column may be flowing with a clockwise swirl while the annular outer stream 31 is flowing upwardly with a counterclockwise swirl. This counter flow of sludge in opposite directions within the inlet conduit 15 gives rise to the designation of the pump as being an Eddy Pump. The upwardly traveling stream 31 has a high angular velocity and a high forward velocity so that the pump casing 14 is rapidly replenished with sludge for discharge from the outlet 18. By way of example, a 6-inch diameter inlet pump driven by a 100 h.p. motor operating at 1800 r.p.m. was able to pump 800 to 1000 gallons per minute of activated sludge having a solids content of 14.3% by weight or organic material with a 16-foot high discharge head for a long period of time. With less viscous sludge such as activated sludge of about 8% solids of organic materials, approximately 18 cubic yards of sludge was pumped within 50 seconds using a 6-inch diameter pump inlet and a 100 h.p. electric motor operating at 1800 r.p.m. It is thought that with an 8-inch diameter inlet pump that the pump will be able to pump at least 2,000 gallons per minute of sludge having the solids content of 15–17%, a fete which heretofore has not been accomplished. Typically, sludge of a 15–17% solids is scooped with buckets and lifted by cranes into trucks for removal rather than being pumped because conventional pumps will not pump such a semi-solid, highly viscous material.

The pump of the present invention appears to discharge sludge which is less viscous than that of the sludge in the pool 16 and there is an appearance of smoke or gas flowing from the pump discharge 18 indicative of the large amount of gas that was dissolved or trapped within the activated sludge.

Figure 3:
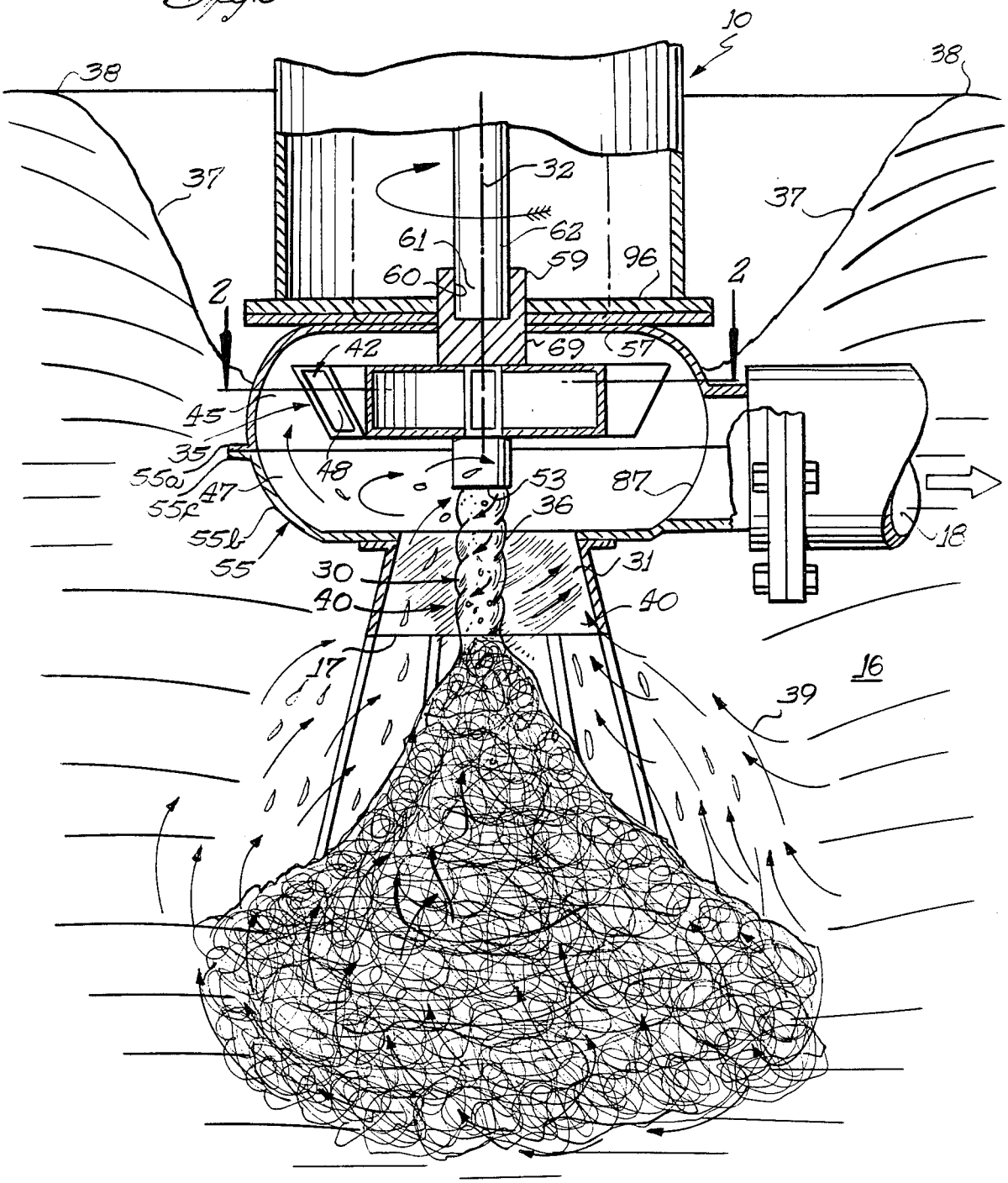
FIG. 3 is an enlarged view of the pumping apparatus pumping sludge in accordance with the method of the invention.
Figure 4:
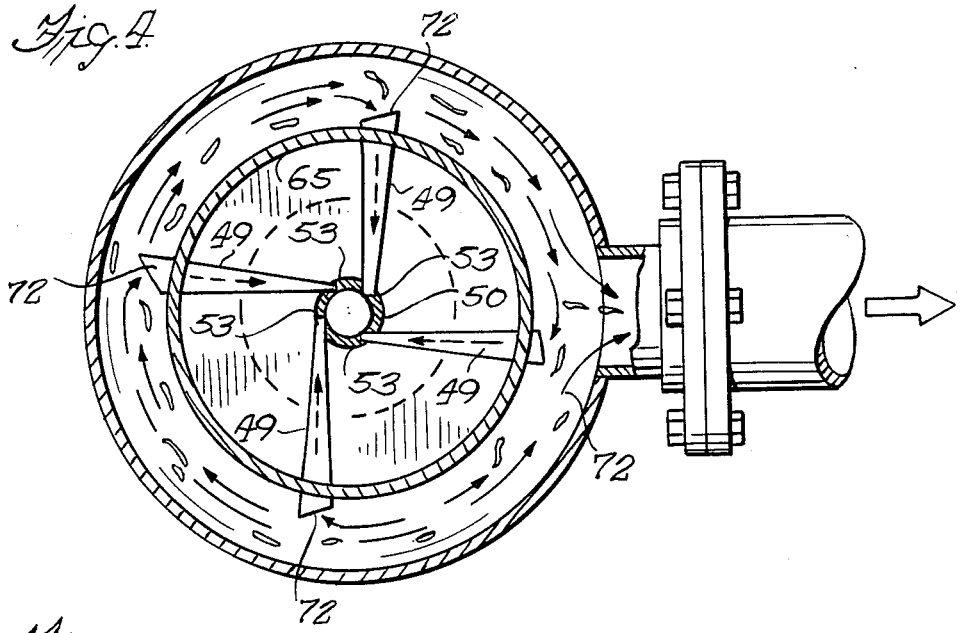
FIG. 4 is a sectional view of reduced size taken along the line 4—4 of FIG. 3.
Figure 5:
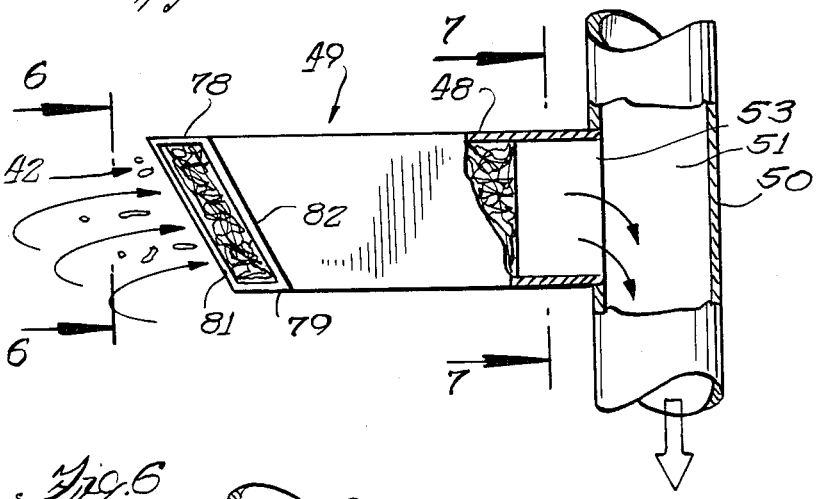
FIG. 5 is a fragmentary view of a portion of the rotating runner.
Figure 6:
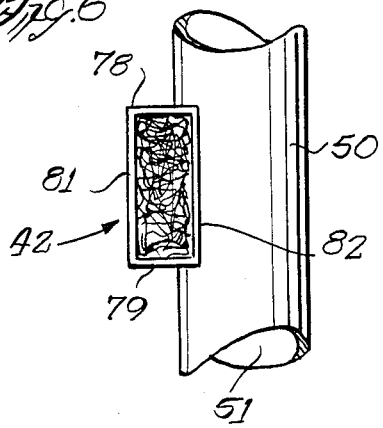
FIG. 6 is a view looking along the line 6—6 of FIG. 5.

Turning now in greater detail to the construction of the pump as best seen in FIG. 3, the sludge is taken through inlets 42 into the vortex runner 35 from the outer peripheral region 45 of a hollow vortex chamber 47 within the housing 14 and is directed through a plurality of passageways 48, as best seen in FIGS. 3 and 4 which extend and which have reducing cross sectional areas so that the fluid is accelerated as it travels generally radially inwardly to a vortex forming means or tube 50. More specifically, a plurality of passageways 48, there being four in the illustrated embodiment of the invention, each provide an accelerating stream of fluid to a hollow interior 51 of the vortex tube at discharge surface 53 which are located tangentially to the interior wall of the surface tube so that each fluid stream is given a swirling action as it enters the tube. Because the top of the tube is closed, the combined streams of fluid form the downwardly and swirling stream 30 which rotates about the axis 32 of the runner and discharges as the vortex stream 30 at the outlet end 17 of the inlet 15.

Figure 1:
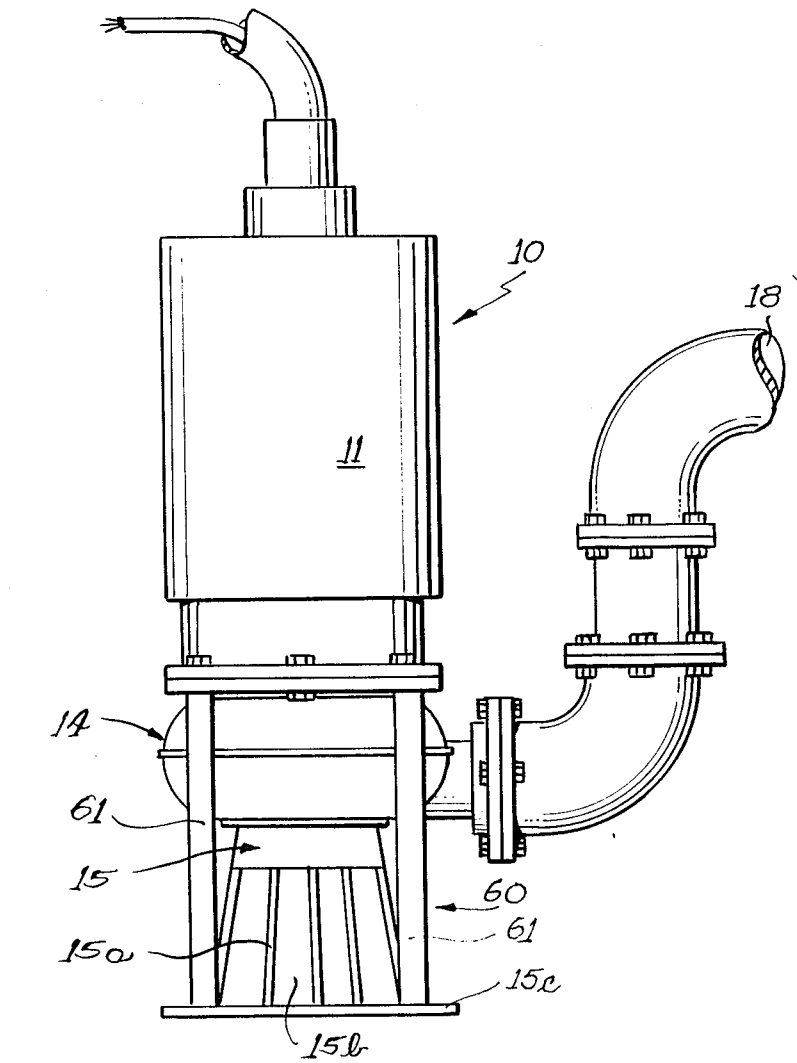
FIG. 1 is a front elevational view of a pumping apparatus constructed in accordance with the invention.

Referring now in greater detail to the illustrated embodiment of the invention, the pump casing 14 shown in FIGS. 1 and 2 is formed with a rounded, truncated spherical metal wall 55 having an axis coaxial with the axis 32 which extends through the runner drive shaft 12 and through the pump inlet 15. The casing 14 includes a top circular wall 57 which has a hub 59 of the runner projecting therethrough. The hub 59 has a hollow bore 60 into which is projected a stub end 61 of the electric motor's driving shaft 62. A spring 63 about the electric motor forces a seal plate 64 against the pump casing wall to seal therewith.

An area of negative pressure is established in operation of the pump about the upper hub 59 adjacent the opening 69 in the top casing wall such that any leaking fluid is pulled inwardly into the pump casing 14 rather than moving upwardly into the motor 11 to contaminate the bearings which are within the electric motor in this instance. The motor contains a separate oil bath and another second seal to sense liquid entering into the oil bath and to signal leakage. Herein, the pump casing is formed with upper and lower halves **55*a* and 55*b* each of which has a circular outer flange 55*c* bolted to the other flange. The lower halve 55*b* has a flat circular bottom wall 59 defining an inlet opening 73** into the pump casing.

The inlet 15 is preferable in the form of a metal frustoconical pipe which is secured to the bottom wall 59 of the casing at the opening in the center thereof. The illustrated inlet 15 is slightly conical in shape to assist in inward flow. To allow the pump to still pump while resting on the bottom of the sludge pool, the inlet 15 includes a plurality of wires or bars **15*a* spaced from each other by openings 15*b* through which the fluid flows. At the lower ends of the bars 15*a* is secured a hollow ring 15*c* through the center of which flows the sludge until the ring 15*c* rests on the bottom of sludge pool. As shown in FIG. 1, a suitable stand 60 having four legs 61 may be used to support the weight of the motor and pump with the legs 61 connected to the flanges and to the ring 15*c*. Often, the inlet 15 will include an elongated hose or pipe extending from the pump housing to a remotely opening located for the hose which is submerged in sludge. It is to be understood that the casing 14 and inlet conduit 15** may take many shapes and that the cylindrical shapes described and shown herein are merely illustrative and are not by way of limitation of the claimed subject matter.

The motor drive means 11 for the vortex generating member 35 includes the electric motor, in this instance, which is mounted on the stand 60 above the pump casing. The motor has a lower annular flange 96 bolted and sealed to an upper flange 97 on the pump casing upper half. The rotational axis of the electric motor 11 and the driven shaft 12 are along the pump axis 32. For sludge applications, the motors may be a submersible motor if there is concern about the electric motor being shorted out. It is not necessary to fully submerge the motor to get a head lift, e.g. of 16 feet or more. A non-submersible motor with an inlet hose having an opening below the surface 38 of the sludge pool 16 and the motor above the sludge pool works satisfactorily.

The preferred and illustrated vortex generating member or runner 35 shown in FIGS. 2–6 comprises a generally hollow conical shell having an outer conical wall 65 covered at the top by an upper circular horizontally extending top plate 66 to which is fastened the hub of the runner. It is preferred to space the peripheral edge 70 of the upper plate 66 of the vortex forming member at a considerable distance from the casing side wall 55 to alleviate the chance of jamming or otherwise binding the rotating runner 35 by solid material compaction therebetween. Preferably, the inlet ends 42 to the passageways 48 are formed in the manner of scoops with an inclined forward wall 72 (FIG. 4) with the scoops rotating in the counterclockwise direction shown in FIG. 4 to scoop in sludge through the inlets 42. Each of the inlets 42, is at the same radial distance from the central pump axis 32; and each passageway 48 provides the same flow path between its inlet 42 and the vortex tube 50 so that the particles of sludge entering each one of the four inlets 42 at the same vertical height in the pump casing undergo the same length of travel and undergo the same acceleration in their travel to the vortex tube and should likewise enter the vortex tube at the same substantially tangential angle to the interior wall 51 of the tube 50 as illustrated in FIG. 4. It will be appreciated that the angle of the passageways 48 to the vortex tube may be changed from tangential to another angle and still form the vortex and fall within the purview of the present invention.

Figure 7:
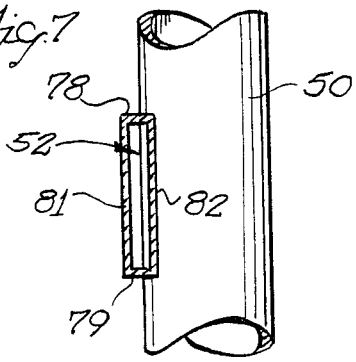
FIG. 7 is a cross-sectional view taken along the line 7—7 of FIG. 5.

The illustrated passageways 48 are each formed in a metal tubular channels 49 of parallel-piped shape having four walls. More specifically, the channels 49 have parallel upper and lower walls 78 and 79 which extend generally horizontal in their direction from the vortex forming tube 50 as best seen in FIG. 3. The upper and lower walls 78 and 79 are joined to vertical channel side walls 81 and 82 which are inclined towards one another from the inlets 42 to their inner discharge outlets or orifices 52 at the vortex forming tube 50. Herein, the side walls 81 and 82 are straight, but in other instances they could be curved. As best seen between the comparison of FIGS. 6 and 7, the cross sectional area at the inlet 42 is about four times larger than the area at discharge orifice 52, as shown in FIG. 7. It will also be appreciated as shown in FIG. 2 that the inlets 42 extend and are generally tapered to be similar to the taper of the conical shell surface 65 from which they project.

From the above, it will be seen that in the preferred embodiment of the invention, sludge in the upper portion of the chamber 47 will be flowing through the inlets 42 whereas the sludge in the lower portion of the pumping chamber will be principally flowing about the vortex column to discharge out the opening 87 (FIG. 2) in the cylindrical side wall 55 to which is attached a discharge pipe 88. The number of discharges may be only one, or a greater number than two, depending upon the end use of the pump.

The vortex tube 50 for forming the vortex initially, and to discharge the same from the rotating member 35 is preferably in the form of a cylindrical metal tube which has been perforated in a vertical direction at four circumferentially, equally spaced locations and to which are welded or otherwise secured the inner ends of the passageway channels 49. As best seen in FIG. 2, the vortex tube 50 extends beneath the lower conical end of the shell 65 to its discharge end 53 which may be spaced a short distance below the shell wall 65. The distance that the vortex tube extends downwardly may be increased or decreased from that illustrated herein. Herein, the vortex tube 50 is centered in the aperture in the center of the opening of the lower casing half and discharges the small diameter stream 30 of sludge down the center of the inlet 15. The preferred vortex forming means, or tube 50, may be changed considerably in shape and in structure from that shown herein and still fall within the purview of the present invention.

The inlet 15, shown herein, is a frusto-conical metal pipe; but it is to be understood that the particular material used and/or the length of the inlet conduit 15 may be changed substantially from that illustrated herein. It is contemplated that a flexible hose made of plastic, or other materials, may be attached to the inlet 15 and extend for long distances, for example, 70 feet or more. Likewise, a long discharge pipe or hose may be included at the pump outlet.

From the foregoing, it will be seen that rather than having closely-fitted members and casings or housings, as in the conventional centrifugal pump, the preent invention uses the formation of pressurized, traveling and rotating stream 30 which is a highly rotational, narrow, almost cylindrical band of sludge which tapers and spreads slightly in the downward direction within the inlet tube until exiting the same at which time all of the energy concentrated into the vortex stream is released into the ambient pool of sludge around the inlet end and this together with the whirling action reduces the viscosity of the sludge and lifts this reduced viscosity sludge to form an upwardly traveling sludge to form an upwardly traveling stream 31 with an upward counter rotational movement to that of the flowing stream 30. Preferably, the pump shown in FIG. 1 should be submerged initially to assure the initial formation of the vortex. It is believed that the sludge exiting the inlet 15 creates the area of lowest pressure or greatest suction at the pump inlet in contrast to conventional pumps in which lowest pressure is created in the pump housing under the impeller. Most of the liquid entering the pumping chamber 47 is discharged out the outlets 18 while some of the liquid flows thereabove and is scooped into the openings in the rotating vortex forming runner. However, it is the unique acceleration of the liquid from the outer region 45 into the centrally located vortex forming tube 50 with each of accelerated sludge jets coming into the vortex tube that provides the circular motion to form the vortex which then forms a very tight spiral or stream 30 of sludge flowing downwardly from the tube and across a portion of the chamber and through the inlet conduit. Each of the accelerating streams in the runner passageways is identical so that they are in harmony with each adding to the other without creating turbulences or other counterflows that would subtract from their accumulative effect on each other. Although four channels 49 with passageways are used herein in the vortex generating runner, this number may be varied to have either fewer or more channels.

Various structures have been illustrated herein, other improved embodiments may use various other forms of structure and still fall within the purview of the present invention. For instance, it is contemplated that improved results may be obtained by forming the passageways 48 in a convolute shape with a large outer diameter to cause the sludge to spiral downwardly and inwardly through a tapered, reducing and cross section to accelerate the sludge continuously in not only a radial but also in a downward direction until it enters the vortex tube.

By way of analogy only, the swirling column of sludge could be considered to a whirlpool but flowing downwardly. On the other hand, if the inlet pipe 15 were submerged and upstanding from the casing, the sludge vortex column would be traveling upwardly as in a whirlpool. In tornadoes or whirlpools, the high angular velocity flow is known to create very great suction to pull material inwardly to the vortex and to be lifted thereby. It is thought that the present invention may be analogous to such naturally occurring phenomena.

What is claimed is:

1. A method of pumping viscous fluids with a pump having a pump chamber and having an inlet and an outlet to the pump, said method comprising the steps of:

creating a pressurized, traveling stream of viscous fluid within the pump chamber of the pump, directing the pressurized, traveling stream of viscous fluid through the inlet of the pump and discharging the pressurized traveling stream of fluid out the inlet to agitate and cause turbulence in the viscous fluid pool around the inlet, flowing the fluid from the pool through the inlet and about the pressurized traveling stream in an inward direction into the pump chamber, and discharging fluid from the pump chamber through the outlet for the pump.

2. A method in accordance with claim 1 including the steps of discharging the pressurized, traveling stream into a pool of thixotropic viscous fluid and imparting shear energy to the thixotropic viscous fluid to reduce the viscosity of the fluid flowing into the pump inlet.

3. A method in accordance with claim 1 including the step of rotating the fluid in a runner in a vortex chamber to flow radially inward while being rotated at a velocity in excess of 1800 r.p.m.

4. A method in accordance with claim 1 including the step of pumping sludge having a solids contents of greater than 10% by weight of organic material therein, and pumping said sludge having greater than 10% solids at a flow rate of excessive 1000 gallons per minute.

5. A method of transporting digested sludge having a solids content by weight of 15% or greater and including the steps of forming a moving stream of said sludge at the pump inlet and agitating the sludge pool about the pump inlet by said moving stream, traveling the agitated sludge into the pump inlet and discharging the fluid stream of greater than 15% solids sludge from the outlet of the pump.

6. An apparatus for pumping a viscous fluid comprising:

a motor drive, a pump having a casing with an internal chamber, an inlet to said pump casing for inward flow of viscous fluid to said chamber, a runner in said pump rotatable in said chamber and connected to said motor drive to be driven thereby, said runner having means therein for conveying sludge radially inwardly into a pressurized traveling stream while being rotated in said chamber and for emitting the pressurized, traveling stream of rotating fluid from the pump inlet into a pool of sludge at the pump inlet to agitate the viscous fluid about the pump inlet, said inlet having a conduit wall for containing an annular stream of inwardly traveling fluid flowing into the pump chamber, and a discharge outlet on said pump casing connected to said chamber to discharge the fluid from the pump casing.

7. A method of pumping viscous thixotropic fluids with a pump having a pump chamber, a rotating runner with radially directed channels leading to a central vortex member, an inlet, and an outlet, said method comprising the steps of:

rotating the runner and forcing the fluid to flow radially inwardly to the vortex member and discharging from the vortex member a pressurized, traveling stream of viscous fluid within the pump chamber, directing the pressurized, traveling stream of viscous fluid through an inlet to the pump and discharging the pressurized traveling stream of fluid out the inlet to agitate and cause turbulence in the viscous thixotropic fluid pool around the inlet thereby reducing the viscosity of the thixotropic fluid in the pool located about the inlet, flowing the fluid of reduced viscosity through the inlet and about the pressurized traveling stream in an inward direction into the pump chamber, and discharging fluid from the pump chamber through the outlet for the pump.

8. A method in accordance with claim 7 including the step of rotating the fluid in a runner having a velocity in excess of 1800 r.p.m.

9. A method in accordance with claim 8 including the step of pumping said sludge having a solids contents of greater than 10% by weight of organic material therein.

* * * * *